US006766593B2

(12) United States Patent
Laudat et al.

(10) Patent No.: US 6,766,593 B2
(45) Date of Patent: Jul. 27, 2004

(54) DEVICE FOR DRYING SOLVENT-BASED INK

(75) Inventors: Andreas Laudat, Meckesheim (DE); Holger Metzner, Nussloch (DE); Roland Walter, Altlussheim (DE)

(73) Assignee: Leica Microsystems Nussloch GmbH, Nussloch (DE)

( * ) Notice: Subject to any disclaimer, the term of this patent is extended or adjusted under 35 U.S.C. 154(b) by 0 days.

(21) Appl. No.: 10/104,460

(22) Filed: Mar. 22, 2002

(65) Prior Publication Data

US 2002/0139004 A1 Oct. 3, 2002

(30) Foreign Application Priority Data

Mar. 27, 2001 (DE) ..... 101 15 066

(51) Int. Cl.[7] ..... F26B 3/34

(52) U.S. Cl. ..... 34/275; 34/68; 34/107; 34/90

(58) Field of Search ..... 34/275, 60, 68, 34/90, 107, 202

(56) References Cited

U.S. PATENT DOCUMENTS 4,276,479 A * 6/1981 Mibu et al. ..... 250/492.1
5,124,559 A * 6/1992 Zertani et al. ..... 250/492.1
5,228,206 A * 7/1993 Grant et al. ..... 34/275
5,604,990 A * 2/1997 Takekoshi ..... 34/68
5,821,115 A 10/1998 Graupner
6,328,445 B1 * 12/2001 Buazza ..... 351/159

FOREIGN PATENT DOCUMENTS

GB 2 206 083 A 12/1988
GB 2 235 163 A 2/1991

OTHER PUBLICATIONS

"Einbettung–Und Schneideverfahren für mikroskopische Präparate" (Embedding and sectioning methods for microscopic preparations), Ernst Leitz GmbH, Liste 530–18a, Sep. 1973.

* cited by examiner

*Primary Examiner*—Ira S. Lazarus
*Assistant Examiner*—Kathryn S. O'Malley
(74) *Attorney, Agent, or Firm*—Hodgson Russ LLP

(57) ABSTRACT

An apparatus (1) for drying solvent-based ink is described, in which the ink is applied onto plastic cassettes for histological preparations and/or on glass specimen slides (17) for microscopic thin sections. The apparatus (1) comprises a hot-air blower (2) and/or a flash device (3) for drying the ink.

9 Claims, 2 Drawing Sheets

DEVICE FOR DRYING SOLVENT-BASED INK

CROSS REFERENCE TO RELATED APPLICATIONS

This application claims priority of the German patent application 101 15 066.0 filed Mar. 27, 2001 which is incorporated by reference herein.

FIELD OF THE INVENTION

The invention concerns an apparatus for drying solvent-based ink, in particular of imprinted plastic cassettes for histological preparations and/or of imprinted glass specimen slides for microscopic thin sections.

BACKGROUND OF THE INVENTION

For the microscopic observation of preparations, in particular histological preparations, the latter must first be subjected to a chemical treatment in which the water contained in the specimen is removed and is replaced, for example, by paraffin or another medium. For this chemical treatment, the specimens are introduced into plastic cassettes. A cassette of this kind is depicted and described in, for example, U.S. Pat. No. 5,821,115 A.

Formulas for this kind of specimen treatment are known, for example, from the document "Embedding and sectioning methods for microscopic preparations [Einbettung-und Schneideverfahren für mikroskopische Präparate], Ernst Leitz GmbH, Liste 530-18a, September 1973." The preparation methods described are characterized in that water is removed from the preparation with ethanol/ethyl ether/propanol, and the preparation is then embedded in paraffin/methacrylate. It is understood that the plastic cassettes and the materials that are used must not react with the chemical reagents.

In this treatment, the specimens are stabilized to the extent that by means of a microtome, thin sections of the specimens can be made and can then each be mounted onto a glass specimen slide. Depending on the examination method, several thin sections are made of each preparation and are mounted onto the specimen slides. Prior to the actual microscopic observation, the preparations mounted onto the specimen slides must also be stained. It is usual in this context that not all preparations go through the same staining process, but instead that depending on the examination method, three or more differently stained preparations are produced.

For differentiation and identification, the individual cassettes and specimen slides must be given a label or code. It was hitherto usual to label the cassettes and specimen slides manually in pencil. Graphite was the only medium that was resistant to the reagents of the embedding process, but with the disadvantage that it cannot be applied in smudgeproof fashion. With manual labeling of the cassettes and/or specimen slides, however, errors can occur which then result in medical misdiagnoses.

For this reason, computer-assisted labeling systems have been developed which have largely eliminated these manual labeling errors. The difficulty that exists with these labeling systems is that of finding a suitable printing or writing medium. This medium must be characterized in that it resists a wide variety of chemical solvents and reagents, and adheres securely both to the plastic cassettes and to the glass of the specimen slide or the coated portion of the specimen slide. In addition, there is very little room on the cassettes and specimen slides for a corresponding code, so that the code or label must be applied in correspondingly delicate fashion.

GB Patent 2 206 083 discloses an "engraving machine" for a specimen slide and/or a cassette. This engraving device is controlled via a computer and an interface, and allows corresponding markings to be scratched into the cassette or specimen slide. It is disadvantageous, however, that this machine is very loud and very slow in operation, and also produces a great deal of debris due to the engraving. The engraved code is moreover very difficult to read.

GB Patent 2 235 163 A discloses a plotter for plastic cassettes in which labeling is performed with a thermal method using a heatable plotter pin and a carbon ribbon. The disadvantage here is that this method can be applied only to plastic, and moreover that only low resolution and a low printing speed can be achieved. The low printing speed results from the fact that the pin must move to each letter individually in the manner of a plotter.

In all known printing systems the resolution is relatively poor, so that only a very "coarse" label can be applied. It is thus not possible to realize the applied code in machine-readable fashion. The application of very thin lines, such as is necessary e.g. for barcodes, is not feasible with any of the known printing devices.

SUMMARY OF THE INVENTION

It is therefore the object of the present invention to optimize the drying process.

An optimum printing result can be achieved only with an inkjet printer and a special ink. A printing system of this kind is depicted and described in the present Application.

This printing system is characterized in that for printing with a piezoelectric printing head, a solvent-based ink comprising a carbon black pigment is used. The carbon black pigment also ensures that a printed barcode exhibits very high contrast.

At room temperature, the applied ink requires approximately 20 seconds until the solvent has evaporated. The ink is then "dry to the touch" and resistant to unintentional smudging. At this stage, however, the ink is not yet resistant to the chemicals of the chemical processes already described. Complete drying of the ink requires a very long period of time.

The apparatus for drying solvent-based ink, in particular of imprinted plastic cassettes for histological preparations and/or of imprinted glass specimen slides for microscopic thin sections, is characterized in that the apparatus comprises a hot-air blower and/or a flash device for drying the ink. The result is that the solvent can evaporate very quickly, and the drying process is thus considerably accelerated. It has proven to be advantageous if the ink, after a pre-drying operation by means of the hot-air blower, is completely dried with the considerably greater energy of a flash lamp. The ink is optimally "cured" because of the high IR and UV energy component of the flash light. Optimum "curing" can only occur, however, if the ink is already dry to the touch, since otherwise the abrupt evaporation of the solvent causes carbon black pigment to be carried off and deposited as a coating on the flash tube and elsewhere. In addition, an increased flash energy consumption is required for the evaporation process.

In a further embodiment of the invention, the flash device comprises a flash tube of U-shaped configuration and a reflector of curved configuration. The radius of the reflector is adapted to the geometrical arrangement and the dimensions of the two limbs of the flash tube. The flash light is thereby reflected to a focal point.

In a further embodiment of the invention, a holding apparatus for the specimen slide and/or cassette is provided in the vicinity of said focal point, so that both the specimen slide and the cassette are held in an optimized position for flash illumination. Also present in this position is a cover apparatus that protects the unimprinted portion of the specimen slide and/or cassette from the flash light. This is advantageous in particular if the cassette or specimen slide already has a preparation in place, and if the latter might be damaged by the high energy of the flash light.

In a further embodiment of the invention, the flash device is equipped with a movable closure. By way of this closure, the specimen slides and/or cassettes can be removed from the flash device and transported to a removal device (not depicted). During the flashing operation, the interior of the flash device is sealed in light-tight fashion.

The invention is also characterized in that the flash device comprises a fan for transporting off the hot air produced in the flash region.

In a further embodiment of the invention, the hot-air blower comprises a heater, a fan, and a hot-air conduit. The hot air is directed through the hot-air conduit onto the cassette and/or specimen slide to pre-dry the ink. It has proven to be advantageous if the fan of the hot-air blower is joined via a conduit system to the flash device, so that the fan draws in air that has already been preheated.

In a further embodiment of the invention, a control device which controls the temperature of the flow of hot air is associated with the hot-air blower. In the context of biological preparations in particular, the flow of hot air on the cassette and/or specimen slide is limited by the control device to 45° C.

In a preferred embodiment of the invention, provision is made for the imprinted plastic cassette and/or imprinted glass specimen slide to be exposed for approximately two seconds to the flow of hot air from the hot-air blower so that the ink is pre-dried, and for the imprinted plastic cassette and/or imprinted glass specimen slide then to be exposed to the light of a xenon flash tube so that the ink is completely dried.

In a further embodiment of the invention, multiple cassettes and/or multiple specimen slides can also be processed concurrently with one another, and the respective ink dried. Mixed operation is also possible.

BRIEF DESCRIPTION OF THE DRAWINGS

The invention will be presented in an exemplary embodiment and explained in more detail with reference to the schematic drawings, in which.

DETAILED DESCRIPTION OF THE INVENTION

Figure 1:
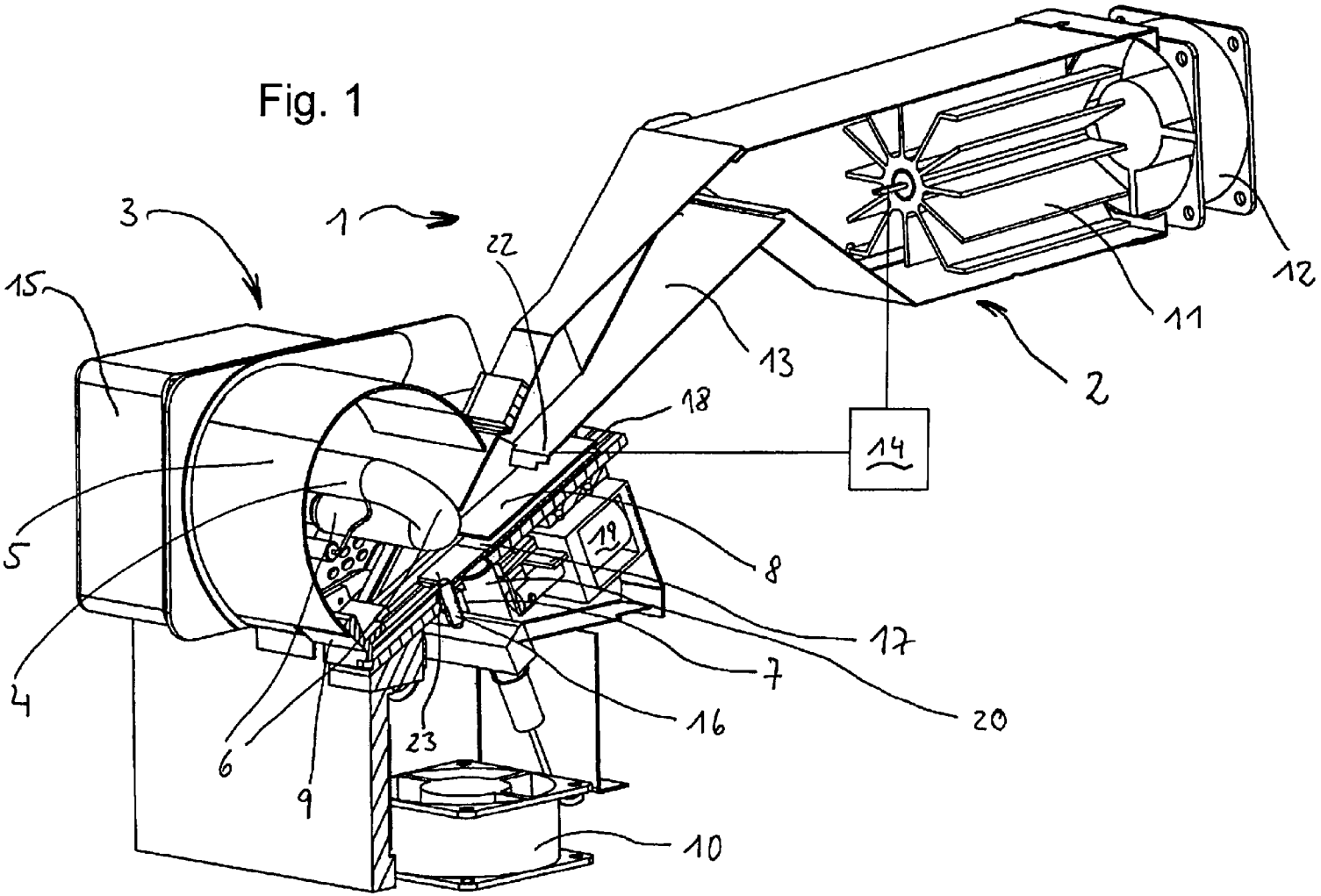
FIG. 1 is a sectioned depiction of the apparatus.
Figure 2:
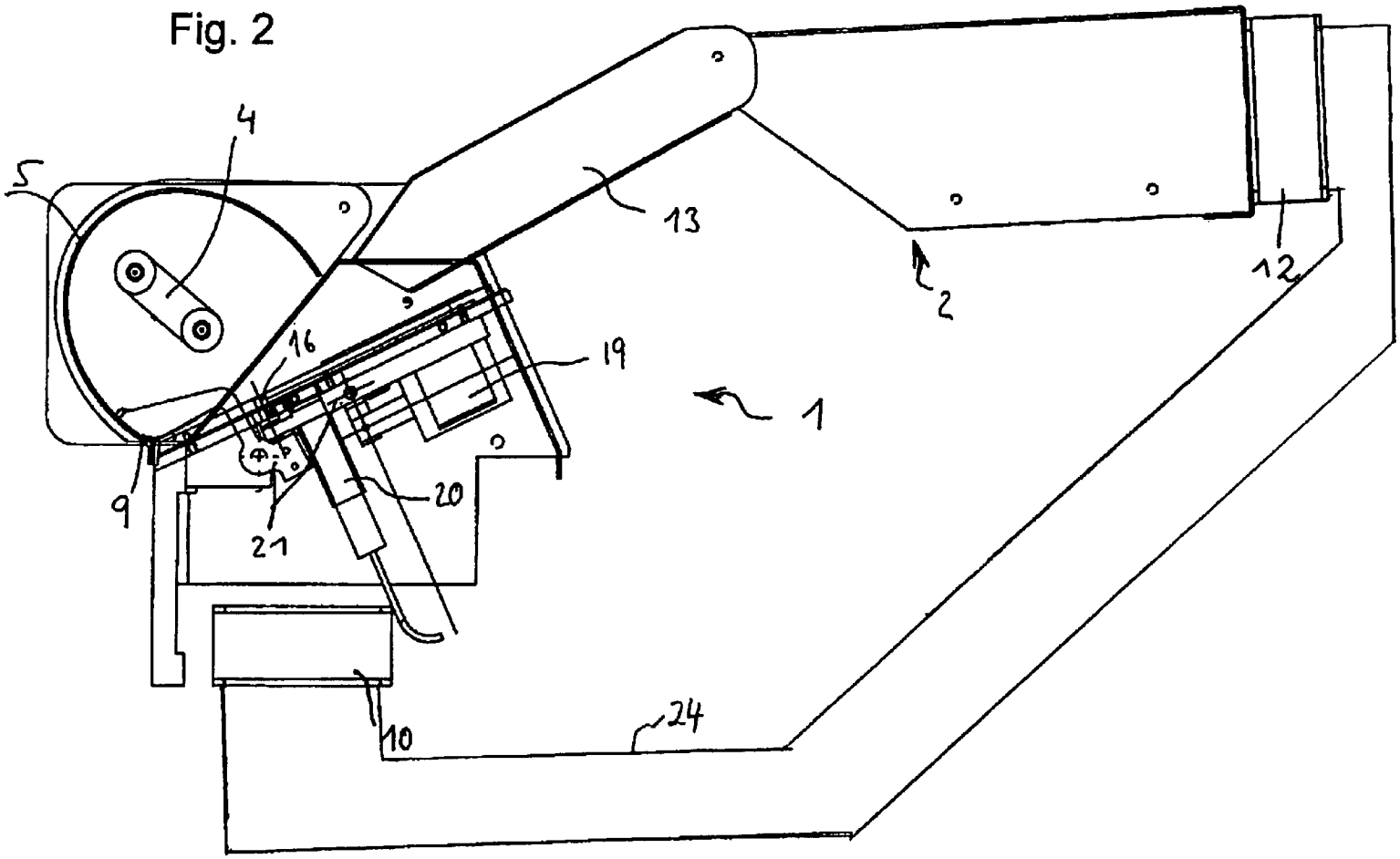
FIG. 2 is a further sectioned depiction of the apparatus.

FIG. 1 shows apparatus 1 for drying solvent-based ink, having a hot-air blower 2 and a flash device 3. Flash device 3 comprises a flash tube 4 of U-shaped configuration having two limbs 6. A reflector 5 and a fan 10 are associated with flash tube 4. A flash electronic system 15 is provided to control flash device 3. Reflector 5 comprises a movable closure 9 that is actuated by a reciprocating magnet 19 and an associated lever device 21 (FIG. 2).

Hot-air blower 2 comprises a heater 11 and an associated fan 12. Heater 11 is electrically connected to a control device 14, to which temperature sensor 22 is connected. Air is drawn in by fan 12, heated by heater 11, and directed through a hot-air conduit 13 onto a specimen slide 17. In a preferred arrangement, fan 12 of the hot-air blower is joined via a conduit system 24 to fan 10 of the flash device, so that the fan 12 draws in air that has already been preheated by the flash device. Specimen slide 17 has a coated surface 23 for ink imprinting.

Specimen slide 17 is positioned in a holding apparatus 7. Holding apparatus 7 comprises a chute 18 as support and for transporting specimen slide 17, and is equipped with a locking pin 16. Locking pin 16 is mechanically connected to reciprocating magnet 19. By means of locking pin 16, specimen slide 17 is held on chute 18. In order to shield the unimprinted portion of specimen slide 17, there is arranged in holding apparatus 7 a cover apparatus 8 with which the unimprinted portion of specimen slide 17 is protected from the flash light. Also associated with holding apparatus 7 is a sensor 20 that records, and conveys to a control device (not depicted), the presence of specimen slide 17.

The imprinted specimen slide 17 is first pre-dried with the air from hot-air blower 2, the air temperature being continuously monitored by way of temperature sensor 22 and control device 14. After pre-drying, flash tube 4 is triggered by flash electronic system 15 and completely dries the ink on specimen slide 17. Locking pin 16 is then moved by reciprocating magnet 19 out of chute 18 and movable closure 9 is simultaneously opened, so that specimen slide 17 is delivered to a downstream removal apparatus.

FIG. 2 shows a different section through the apparatus, here depicting lever device 21 for opening closure 9 and for actuating locking pin 16 with reciprocating magnet 19.

The invention is of course not limited to the exemplary embodiment depicted and described. Other imprinted materials and other imprinted objects can, however, also be used. In particular, the glass specimen slides can also have a coating for the ink to be printed onto.

Parts List

1 Apparatus for drying solvent-based ink
2 Hot-air blower
3 Flash device
4 Flash tube
5 Reflector
6 Limb of 4
7 Holding apparatus
8 Cover apparatus
9 Movable closure
10 Fan (flash device)
11 Heater
12 Fan (hot-air blower)
13 Hot-air conduit
14 Control device
15 Flash electronic system
16 Locking pin
17 Specimen slide
18 Chute
19 Reciprocating magnet
20 Sensor
21 Lever device
22 Temperature sensor
23 Coated (and imprinted) surface of 17
24 Preheated-air conduit

What is claimed is:

1. An apparatus for drying solvent-based ink, in particular of imprinted plastic cassettes for histological preparations and/or of imprinted glass specimen slides for microscopic thin sections, said apparatus comprising:

a hot-air blower for pre-drying said ink; and a flash device operating after said hot-air blower for finish-drying said pre-dried ink, said flash device comprising a flash tube of U-shaped configuration having a pair of limbs and a reflector of curved configuration, wherein the curvature of the reflector is configured in such a way that light from said pair of limbs of said U-shaped flash tube is reflected to a common focal point.

2. The apparatus as defined in claim 1, further comprising a holding apparatus for said specimen slide or cassette, said holding apparatus being arranged in the vicinity of said focal point.

3. The apparatus as defined in claim 1, wherein said flash device comprises a cover apparatus, and said cover apparatus protects an unimprinted portion of said specimen slide or cassette from flash light.

4. The apparatus as defined in claim 1, wherein said flash device comprises a movable closure for sealing an interior of said flash device in light-tight fashion during a flashing operation.

5. The apparatus as defined in claim 1, wherein said flash device comprises a fan.

6. An apparatus for drying solvent-based ink, in particular of imprinted plastic cassettes for histological preparations and/or of imprinted glass specimen slides for microscopic thin sections, said apparatus comprising:

a hot-air blower for pre-drying said ink, said hot air blower comprising a heater, a fan near said heater, and a hot-air conduit, whereby hot air is directed through the hot-air conduit onto the cassette and/or specimen slide; and a flash device operating after said hot-air blower for finish-drying said pre-dried ink wherein said fan of said hot-air blower is joined via a conduit system to said flash device, whereby air that has already been preheated can be drawn in by said fan of said hot-air device.

7. The apparatus as defined in claim 6, further comprising a control device for controlling the temperature of hot air from said hot-air blower.

8. The apparatus as defined in claim 7, wherein said control device limits the temperature of hot air flow on said ink to 45° C.

9. The apparatus as defined in claim 6, wherein said flash device comprises a xenon flash tube, said imprinted plastic cassettes and imprinted glass specimen slide are exposed for approximately two seconds to the flow of hot air from said hot-air blower so that said ink is pre-dried, and the imprinted plastic cassettes and imprinted glass specimen slides are then exposed to light from said xenon flash tube so that the ink is completely dried.

* * * * *